US011550267B2

(12) United States Patent
Wagnière

(10) Patent No.: US 11,550,267 B2
(45) Date of Patent: Jan. 10, 2023

(54) DEVICE FOR ADJUSTING THE FUNCTIONS OF A TIMEPIECE

(71) Applicant: Société anonyme de la Manufacture d'horlogerie Audemars Piguet & Cie, Le Brassus (CH)

(72) Inventor: Natacha Wagnière, Orzens (CH)

(73) Assignee: Manufacture d'Horlogerie Audemars Piguet SA, Le Brassus (CH)

( * ) Notice: Subject to any disclaimer, the term of this patent is extended or adjusted under 35 U.S.C. 154(b) by 729 days.

(21) Appl. No.: 16/496,447

(22) PCT Filed: Mar. 8, 2018

(86) PCT No.: PCT/EP2018/055775
§ 371 (c)(1),
(2) Date: Sep. 22, 2019

(87) PCT Pub. No.: WO2018/172093
PCT Pub. Date: Sep. 27, 2018

(65) Prior Publication Data

US 2020/0026242 A1 Jan. 23, 2020

(30) Foreign Application Priority Data

Mar. 22, 2017 (CH) ..... 00368/17

(51) Int. Cl.
*G04B 27/02* (2006.01)
*G04B 13/00* (2006.01)
(Continued)

(52) U.S. Cl.
CPC ..... *G04B 27/02* (2013.01); *G04B 13/002* (2013.01); *G04B 19/25* (2013.01); *G04B 3/04* (2013.01)

(58) Field of Classification Search
CPC .... G04B 27/02; G04B 27/023; G04B 27/026; G04B 13/002; G04B 19/25; G04B 3/04
See application file for complete search history.

(56) References Cited

U.S. PATENT DOCUMENTS 325,536 A 9/1885 Hart
3,470,687 A 10/1969 Ono et al.
(Continued)

FOREIGN PATENT DOCUMENTS

CH 548 632 11/1973
CH 592 325 3/1977
(Continued)

*Primary Examiner* — Edwin A. Leon
*Assistant Examiner* — Jason M Collins
(74) *Attorney, Agent, or Firm* — Christensen, Fonder, Dardi & Hebert PLLC

(57) ABSTRACT

A device for adjusting horological functions of a timepiece, including a mechanism for selection and actuation, including: a drive driving a driving pinion in the clockwise and anti-clockwise directions, a driven pinion driven when the driving pinion turns clockwise and anti-clockwise, the driven pinion moving into a first position by the driving pinion turning clockwise, in which the driven pinion actuates an actuator of a first horological function, and moving into a second position by the driving pinion turning anti-clockwise, in which second position, the driven pinion actuates an actuator of a second horological function, the driven pinion not actuating the actuator of the first horological function when it is in its second position, and vice versa. The mechanism for selection and actuation includes at least two driven pinions, and the adjusting device includes a control mechanism selectively bringing the driving pinion into engagement with each of the driven pinions.

14 Claims, 4 Drawing Sheets

(51) Int. Cl.
*G04B 19/25* (2006.01)
*G04B 3/04* (2006.01)

(56) References Cited

U.S. PATENT DOCUMENTS

| | | | |
|---|---|---|---|
| 3,645,090 | A | 2/1972 | Mochizuki et al. |
| 3,659,413 | A | 5/1972 | Tanaka et al. |
| 3,775,966 | A | 12/1973 | Matsuura |
| 3,798,893 | A | 3/1974 | Ippoushi |
| 3,922,846 | A | 12/1975 | Gerber et al. |
| 4,766,579 | A | 8/1988 | Spörring |
| 6,295,249 | B1 | 9/2001 | Takahashi et al. |
| 6,520,674 | B1 | 2/2003 | Tokoro |
| 7,218,576 | B1 | 5/2007 | Bron |
| 9,557,715 | B2 | 1/2017 | Goldmann |
| 2001/0046187 | A1 | 11/2001 | Graemiger |
| 2004/0095850 | A1 | 5/2004 | Schmiedchen et al. |
| 2009/0010109 | A1 | 1/2009 | Graemiger et al. |
| 2012/0182838 | A1 | 7/2012 | Farron et al. |
| 2013/0250737 | A1 | 9/2013 | Villar |
| 2014/0056112 | A1 | 2/2014 | Villaret |
| 2014/0056114 | A1 | 2/2014 | Monferrer et al. |
| 2014/0177397 | A1 | 6/2014 | Rudaz et al. |
| 2016/0124388 | A1 | 5/2016 | Neboisa et al. |
| 2018/0107163 | A1 | 4/2018 | Bonvin et al. |

FOREIGN PATENT DOCUMENTS

| | | | |
|---|---|---|---|
| CH | 700 3 67 | A2 | 8/2010 |
| CH | 706 265 | A2 | 9/2013 |
| CH | 706 341 | A2 | 10/2013 |
| CH | 707 870 | A1 | 10/2014 |
| CN | 1330780 | A | 1/2002 |
| CN | 2513140 | Y | 9/2002 |
| CN | 101236402 | A | 8/2008 |
| CN | 101872153 | A | 10/2010 |
| CN | 103052919 | A | 4/2013 |
| CN | 103513562 | A | 1/2014 |
| CN | 203786472 | U | 8/2014 |
| CN | 105988353 | A | 10/2016 |
| DE | 2 031 216 | | 1/1971 |
| EP | 1 043 634 | A1 | 10/2000 |
| EP | 1 122 619 | A1 | 8/2001 |
| EP | 1 152 303 | A1 | 11/2001 |
| EP | 1 925 996 | A1 | 5/2008 |
| EP | 1 953 611 | A1 | 8/2008 |
| EP | 2 012 199 | A2 | 1/2009 |
| EP | 2 410 389 | A1 | 1/2012 |
| EP | 2 444 861 | A1 | 4/2012 |
| EP | 2 453 322 | A1 | 5/2012 |
| EP | 2 523 054 | A1 | 11/2012 |
| EP | 2 642 3 54 | A1 | 9/2013 |
| EP | 2 701 014 | A1 | 2/2014 |
| EP | 2 701 015 | A1 | 2/2014 |
| EP | 3 070 543 | A1 | 9/2016 |
| ER | 2169861 | | 9/1973 |
| FR | 2144826 | | 2/1973 |
| GB | 1140930 | | 1/1969 |
| JP | S 48-33336 | Y1 | 10/1973 |
| JP | S 62-177475 | A | 8/1987 |
| JP | H 11-183649 | A | 7/1999 |
| JP | 2016-206002 | A | 12/2016 |
| WO | WO 99/34262 | A1 | 7/1999 |
| WO | WO 02/077721 | A1 | 10/2002 |
| WO | WO 2012/175595 | A1 | 12/2012 |
| WO | WO 2014/166798 | A2 | 10/2014 |
| WO | WO 2016/155814 | A1 | 10/2016 |

DEVICE FOR ADJUSTING THE FUNCTIONS OF A TIMEPIECE

PRIORITY CLAIM

The present application is a National Phase entry of PCT Application No. PCT/EP2018/055775, filed Mar. 8, 2018, which claims priority from Swiss Patent Application Number 00368/17, filed Mar. 22, 2017, the disclosures of which are hereby incorporated by reference herein in their entirety.

FIELD OF THE INVENTION

The present invention relates to a device for adjusting the functions of a timepiece.

More particularly, the invention relates to a device for adjusting the horological functions of a timepiece, the device being equipped with a mechanism for selection and actuation comprising a drive means and a driving pinion, said drive means being configured to drive said driving pinion in the clockwise direction and in the anti-clockwise direction, and at least one driven pinion arranged to mesh with said driving pinion when the driving pinion turns in the clockwise direction and when said driving pinion turns in the anti-clockwise direction.

BACKGROUND OF THE INVENTION

This type of adjusting device is used in mechanical timepieces comprising an indicator of a horological function derived from time, such as the days of the month, the days of the week, the phases of the moon, the various time zones, as well as other functions. Many prior art documents describe embodiments.

Swiss patent application CH 707 870 discloses a mechanism for selecting and actuating n functions of a horological movement, comprising a winding stem which is capable of meshing with an actuation device of one function, this latter being arranged in a manner such as to be capable of displacement and occupying n selection positions and n actuation positions, in which the actuating device is kinematically connected to an actuation means in order to permit the actuation of the function in question. The mechanism also comprises a selector device which can be used to displace the actuation device into a selection position. The mechanism also comprises a base on which the actuation device is mounted in a movable manner so that, under the action of said selector device, it can be positioned in a selection position as well as, under the action of an axial displacement of the winding stem, it can be positioned in an actuation position. The document states that the proposed mechanism for selection and actuation works in a bidirectional manner.

European patent application EP 2 701 014 discloses a clutch yoke, or in fact a clutch device, for a horological mechanism, comprising at least one element for guiding a correction mobile in rotation, at least one friction element intended to cooperate with a portion of said mobile, and at least one resilient element intended to resiliently return said friction element. These elements permit distribution of the torque resisting rotation between the shaft of the yoke and the shaft of said mobile which is rotatably mounted on the yoke to be established such that a change in the direction of rotation of the mobile will initially pivot the yoke until it reaches a stable position before the mobile itself starts to turn into this position; this is in order to prevent the yoke from remaining blocked in one position, which would then not allow a second attributed function to be carried out and/or would lead the mechanism to be immobilized.

European patent application EP 1 152 303 discloses a mechanism for winding and correction of at least two indicator means, the mechanism being disposed in a manner such that the sliding pinion is only disengaged from the winding pinion in a setting position, by providing two first—and two second superimposed setting wheels as well as two wig-wag pinions for winding, respectively for correction mounted pivotably with the aid of corresponding yokes, in a manner such that this mechanism has the advantages of a conventional winding mechanism controlling two functions while being capable of carrying out a third function such as correction of an indication derived from time.

European patent application EP 2 444 861 discloses a device for selecting functions, in particular for a horological movement, which can be used to connect, at one's own discretion and via a differential, respectively an epicyclic gear train, a driving wheel with one of at least two driven wheels in order to select a corresponding function.

European patent application EP 2 012 199 discloses a timepiece provided with a device for adjusting the horological functions and indications, comprising a means for selecting each horological indication to be adjusted and a means for adjusting the selected horological indications. At least the means for selecting the indication to be adjusted is kinematically connected to a selection cam comprising a corresponding profile with two states, respectively corresponding to a non-selection state and to a selection state, the adjusting device comprising means for connecting the adjusting means to each of the selected horological indications.

European patent application EP 2 701 015 discloses a device for correction of functions displayed by a timepiece, which can be used to modify the information for a plurality of temporal functions displayed by that timepiece. It comprises a pusher for changing the function, the actuation of which displaces a control wheel to bring the latter into engagement with a corrector pinion for the selected function and a stem the rotation of which in one direction or the other pivots the control wheel, which in turn drives one of the corrector pinions in order to correct the information on the selected function upwardly or downwardly, such that that device carries out a bidirectional correction.

Patent application WO 2016/155814 discloses a mechanism for winding and/or correction of at least two horological functions and a device for selection of a horological function from a winding function and a plurality of correction functions, comprising a control member, for example a stem, which can be used to select the winding function by displacement of the control means in a first direction and of sequentially selecting a function from among the plurality of correction functions by displacement of the control member in a second direction.

Swiss patent CH 592 325 discloses a device for rapid correction of the date indications of a calendar watch by rotation of a winding stem which is kinematically connected to the winding wheel train when it is turned in a given direction and which is kinematically connected to a date ring when it is turned in the opposite direction. To this end, the device comprises a mobile crown wheel mounted in a rotational manner on an eccentric axis comprising two opposing segments in the form of a circular arc, in a manner such that said mobile crown wheel meshes with the ratchet wheel when the winding stem is turned in one direction and with a mobile for correction of the date indications when the winding stem is turned in the reverse direction.

French patent application FR 2 169 861 describes a device for setting and correction of a watch with the aid of a winding stem having a delay mechanism. Furthermore, the device comprises a sliding pinion which, in the intermediate position of the winding stem, is capable of meshing with a setting wheel which meshes with an intermediate wheel driving a day and date correction wheel the axis of which is mounted in a displaceable manner in an elongate opening in a lever. The intermediate wheel and the correction wheel are connected via a pivoting lever against which the axes of these wheels bear with a contact friction, in a manner such that the correction wheel pivots in said elongate opening when the pivoting lever pivots about the intermediate wheel, thereby allowing the day and date correction wheel to engage either with a date ring or with a day star drive wheel. Thus, when the winding stem is turned, in its intermediate position, in one direction, the day and date correction wheel meshes with the date ring and can be used to change the date displayed, and when the winding stem, in its intermediate position, is turned in the opposite direction, the day and date correction wheel meshes with the drive wheel and can be used to change the day that is displayed.

Swiss patent CH 548 632 concerns a timepiece equipped with a time setting and correction device, the latter comprising a yoke carrying a correction wheel which can be alternately engaged with winding, setting, correction or the like mobiles. To this end, said yoke can be brought into the desired position by turning a manoeuvring stem, in its pushed in position, whereupon a sliding pinion of said manoeuvring stem drives the yoke via a pinion mounted loosely on the manoeuvring stem. In the pulled-out position of the manoeuvring stem, the sliding pinion of said manoeuvring stem then drives one of the mobiles, as a function of the angular position of the yoke, in a manner such as to permit winding, setting, correction of the date or day displayed, or any other similar horological function.

In summary, the prior art solutions which are known at this time in this field are complex in construction and involve a large number of moving parts and are also bulky as regards thickness. Furthermore, the number of functions that they can be used to adjust is limited, generally to three or four functions, in particular because either a single driven pinion is used or that non-displaceable driven pinions are used.

SUMMARY OF THE INVENTION

An objective of the present invention is to overcome the disadvantages of known devices and in particular to allow a large number of horological functions of a mechanical watch to be adjusted using a small number of moving parts. A further objective is to produce an adjusting device which is not bulky as regards thickness. A further objective of the present invention is to provide an adjusting device the handling of which is very easy for the user. A further objective of the present invention is to produce an adjustment device which is robust in construction as well as reliable.

To this end, the present invention proposes a device for adjusting the horological functions of a timepiece as defined in the claims.

A device of this type is equipped with a mechanism for selection and actuation, comprising

- a drive means,
- a driving pinion, said drive means being configured to drive said driving pinion in the clockwise direction and in the anti-clockwise direction,
- at least one driven pinion arranged to be driven by said driving pinion when the driving pinion turns in the clockwise direction and when said driving pinion turns in the anti-clockwise direction, said driven pinion being configured to move into a first position under the effect of the driving pinion when this turns in the clockwise direction, in which first position said driven pinion actuates an actuating means of a first horological function, and to move into a second position under the effect of the driving pinion when this turns in the anti-clockwise direction, in which second position said driven pinion actuates an actuating means of a second horological function, said driven pinion not actuating the actuating means of the first horological function when it is in its said second position and, vice versa, said driven pinion not actuating the actuating means of the second horological function when it is in its said first position, said mechanism for selection and actuation comprising at least two driven pinions, and the adjusting device furthermore comprising a control mechanism adapted to selectively bring the driving pinion to mesh with each of said driven pinions.

On the one hand, the device defined above therefore employs a single driven pinion to act independently on two functions, for example displaying a date and a day of the week. On the other hand, these actions under the effect of the drive means, irrespective of whether they are generated by a pusher or by a crown stem, are "unidirectional", in the sense that the modification of a displayed indication can only be carried out in one direction, for example by increasing date numbers, because reversing the direction of rotation of the drive means causes decoupling between the actuating means of the first function and the driven pinion as well as coupling of this driven pinion with the actuating means of the second function.

In accordance with one embodiment of the above device, said driven pinion is a sliding pinion the axis of which is constituted by a pin housed in an oblong housing formed in a plate, in a manner such as to slide perpendicularly to said axis, said housing being disposed in a manner such that the pin of the driven pinion moves to a first end of the oblong housing under the effect of the rotation of the driving pinion in the clockwise direction, the driven pinion therefore being in said first position, and that the pin moves to the other end of the oblong housing under the effect of the rotation of the driving pinion in the anti-clockwise direction, the driven pinion then being in said second position.

In accordance with one embodiment, the driven pinion, on the one hand, carries teeth adapted to mesh with the teeth of the driving pinion, and on the other hand carries a coaxial mobile the teeth of which, or respectively an arm, are/is adapted to cooperate with teeth, respectively an actuating means, of a horological function.

In accordance with one embodiment, the driving pinion is in kinematic connection, in particular via setting wheels, with a winding and/or adjusting crown of the timepiece.

In accordance with one embodiment of the above adjusting device, said mechanism for selection and actuation comprises two driven pinions and said control mechanism is configured to alternately bring the driving pinion, by translation, into contact with each of the two driven pinions.

In accordance with one embodiment, the driving pinion is a sliding pinion the axis of which is constituted by a pin housed in an oblong housing formed in said plate, in a manner such as to slide perpendicularly to said axis, said control mechanism controlling sliding of the pin in said housing.

In accordance with one embodiment, the respective ends of the oblong housing of the axis of the driving pinion are arranged in a manner such as to allow effective engagement respectively with each of the driven pinions in each of said first and second positions of said driven pinions.

In accordance with one embodiment, the control device comprises an assembly constituted by a yoke controlled by a wig-wag and a control lever, said assembly being mounted on said plate.

In accordance with one embodiment, said mechanism for selection and actuation comprises a number of driven pinions which is greater than or equal to two, the control mechanism comprises a rotary arm on which the driving pinion is arranged, and said control mechanism is configured to bring the driving pinion into the meshing position with each of the driven pinions by successive rotation.

In accordance with one embodiment, the control mechanism comprises an assembly formed by a star which is coaxial with the axis of articulation of said rotary arm, by a jumper, and by a spring yoke cooperating with said star, a rotation of the star through an angular value corresponding to one branch of the star bringing the driving pinion from a meshing position with a driven pinion into a meshing position with the adjacent driven pinion.

In accordance with one embodiment, the driven pinions are sliding pinions the axis of which are constituted by pins housed in oblong housings of a plate, said oblong housings being arranged tangentially to a circle which is coaxial with the axis of articulation of the rotary arm carrying the driving pinion.

In accordance with one embodiment, the driving pinion is kinematically connected to its drive means via a setting wheel which is coaxial with the axis of articulation of the rotary arm.

Finally, the invention proposes a timepiece comprising a device for adjusting horological functions as defined hereinabove.

Other characteristics, as well as the corresponding advantages, will become apparent from the description below discussing two embodiments of the invention in more detail.

BRIEF DESCRIPTION OF THE DRAWINGS

The accompanying drawings diagrammatically represent, by way of example, two embodiments of the invention.

DETAILED DESCRIPTION OF THE INVENTION

FIGS. 1*a* to 3*b* illustrate a first adjusting device comprising a mechanism for selecting and actuating a function from among four available functions, for example in the context of a display correction device. This mechanism comprises a drive setting wheel 9 which is capable of transmitting a rotational movement to a driving pinion 1 in the clockwise direction and in the anti-clockwise direction, at one's discretion. The axis of the driving pinion 1, which may simply be produced in the form of a pin, may be housed in an oblong slot of a plate or a bridge, not shown in the figures, the ends of which define a first and a second end position of the axis of the driving pinion 1, in a manner such that the driving pinion 1 is a sliding pinion which remains capable of being driven in rotation in these two positions by the setting wheel 9, both in the clockwise direction and in the anti-clockwise direction. The oblong slot in said plate is indicated symbolically as dotted lines in FIGS. 1*a* and 1*b* as well as in FIGS. 3*a* and 3*b*. Alternatively, the axis of the driving pinion 1 may simply be arranged on the control device described below, this latter permitting the axis of the driving pinion 1 to be positioned in its first and second end positions. At either side of the driving pinion 1, which for this reason is in a central position, are two lateral pinions 2 and 3, in a manner such that the central pinion can be moved sufficiently close, in its first or in its second end position, to the one or to the other of the lateral pinions 2, 3 in order to form a kinematic connection between the central pinion 1 and the one or the other of the lateral pinions 2, 3 which alternately become a driven pinion.

Figure 3A:
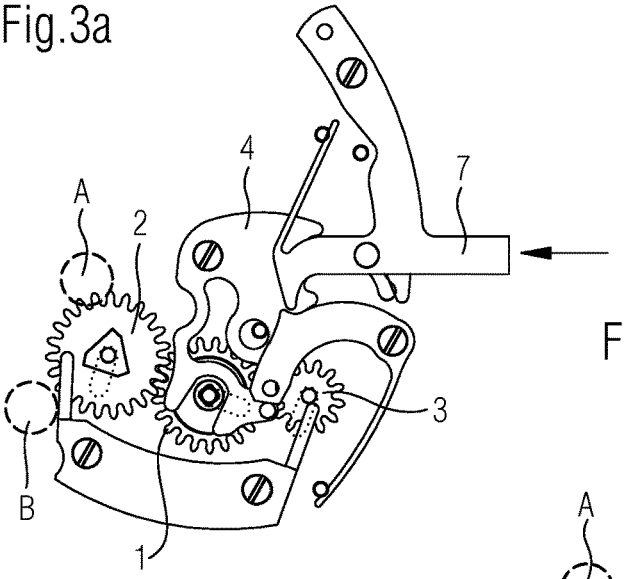
FIG. 3*a* is a top plan view of an adjusting device in accordance with FIG. 1*a* after actuating the control device.
Figure 3B:
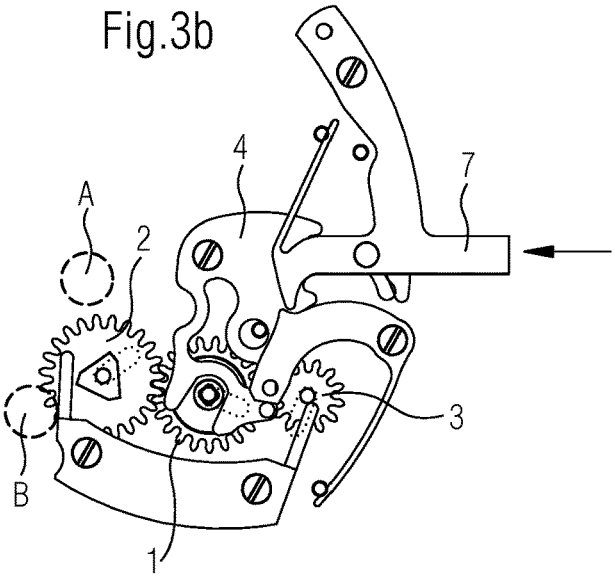
FIG. 3*b* is a top plan view of an adjusting device in accordance with FIG. 3*a* after reversing the direction of rotation of the drive means.

The axes of each of the two lateral pinions 2, 3, which may be constituted by a pin, may also be housed in two respective oblong housings formed in the plate, arranged in a manner such that the pin of the lateral pinion 2, respectively of the lateral pinion 3, kinematically connected with the driving pinion 1, moves to a first end of its oblong housing under the effect of the tangential force resulting from rotation of the driving pinion 1 in the clockwise direction, the driven pinion 2, respectively the driven pinion 3, thus being in a first drive position, and the pin of this lateral driven pinion 2, respectively of the lateral pinion 3, moves to the other end of its oblong housing under the effect of the tangential force resulting from rotation of the driving pinion 1 in the anti-clockwise direction, the driven pinion 2, respectively the driven pinion 3, therefore being in a second drive position. FIGS. 3*a* and 3*b* illustrate this mechanism by showing the lateral pinion 2, driven by the central pinion 1, respectively into the first and into the second drive position of said lateral pinion 2, depending on whether the central pinion 1, which has been kinematically connected to the lateral pinion 2 by the control device described below, turns in the clockwise direction or in the anti-clockwise direction.

Figure 1A:
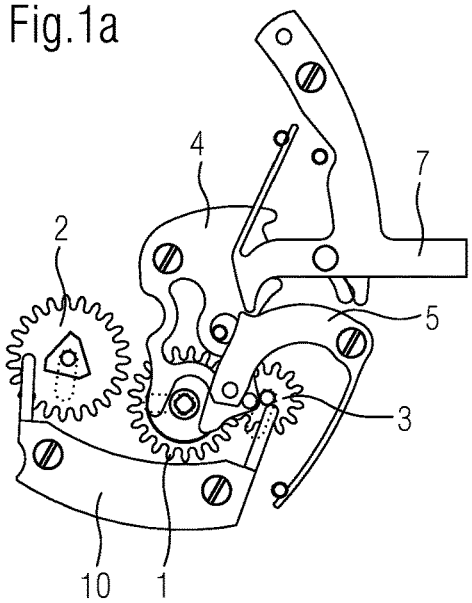
FIG. 1*a* shows a top plan view of a first embodiment of an adjusting device in accordance with the present invention allowing for adjusting four horological functions.
Figure 1B:
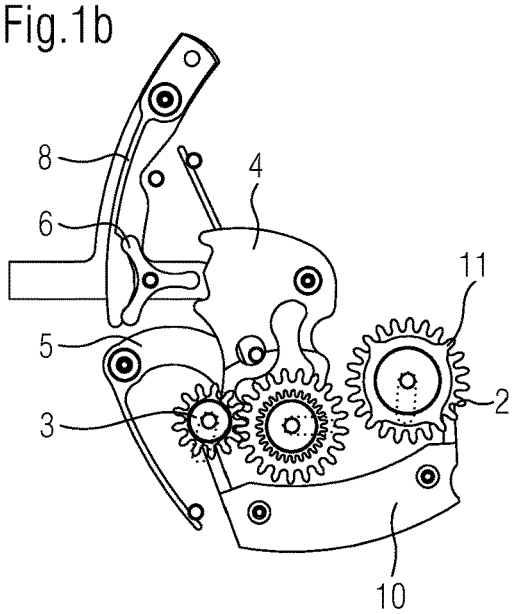
FIG. 1*b* shows a bottom plan view of the adjusting device of FIG. 1*a*.

The oblong housings in said plate housing the axes of the two lateral pinions 2, 3 are symbolically indicated by dotted lines in FIGS. 1*a* and 1*b* and in FIGS. 3*a* and 3*b* and are orientated substantially perpendicularly to the oblong slot in said plate housing the axis of the driving pinion 1. Alternatively, the driven pinions 2, 3 could each be constituted by a ring with external teeth and a circular internal periphery 2*d*, 3*d*, the axes of these driven pinions 2, 3 in this case possibly each being constituted by an eccentric 2*a*, 3*a* fixed to said plate and comprising two opposed circular arcs 2*b*, 2*c*, 3*b*, 3*c* in a manner such that each of these arcs 2*b*, 2*c*, 3*b*, 3*c* can come into contact with said circular internal periphery 2*d*, 3*d* of the corresponding driven ring 2,3 depending on whether the central pinion 1 brought into kinematic connection with the ring 2, 3 turns in the clockwise direction or in the anti-clockwise direction. This alternative configuration, in which the axes of the driven pinions 2, 3 are not fixed to the pinions but to the plate, is illustrated diagrammatically in FIGS. 4*a* and 4*b*. Independently of the specific embodiment of the driven pinions 2, 3, a friction spring 10 comprising lateral arms bearing on the surface of the driven pinions 2, 3 is disposed on said plate in order to secure the driven pinions 2, 3 in their respective axial positions, in a manner such as to ensure the operation of the adjusting device independently of the position in space of the corresponding timepiece.

An actuating means A of a first horological function indicated and an actuating means B of a second horological function are diagrammatically in FIGS. 3*a* and 3*b*, these means A, B being disposed either side of the driven pinion 2 in a manner such as to be able to mesh alternately with the latter as a function of the position of this driven pinion 2. In fact, as can be seen in these two FIGS. 3*a* and 3*b*, the driven pinion 2 is configured to move into a first position under the effect of the driving pinion 1 when this turns in the clockwise direction, in which first position said driven pinion 2 actuates the actuating means A of the first horological function, and to move into a second position under the effect of the driving pinion 1 when this turns in the clockwise direction, in which second position said driven pinion 2 actuates the actuating means B of the second horological function. Said driven pinion 2 does not actuate the actuating means A of the first horological function when it is in its second position and, vice versa, said driven pinion 2 does not actuate the actuating means B of the second horological function when it is in its first position. In analogous manner, the actuating means of a third horological function and an actuating means of a fourth horological function, not illustrated in FIGS. 3*a* and 3*b*, are disposed either side of the driven pinion 3, these means possibly alternately meshing with this driven pinion 3 as a function of its position, when the driving pinion 1 is in the meshed position with this driven pinion 3 and as a function of the clockwise or anti-clockwise direction of rotation of the driving pinion 1.

Figure 2A:
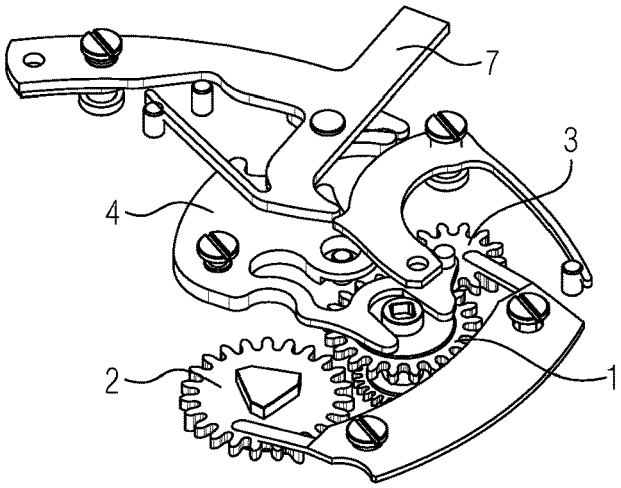
FIG. 2*a* shows a perspective top view of the device of FIG. 1*a*.
Figure 2B:
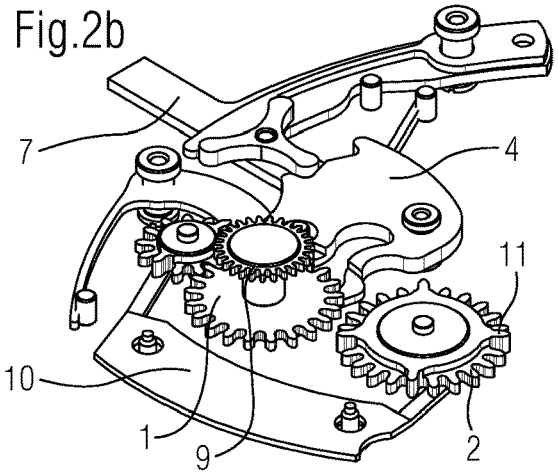
FIG. 2*b* is a perspective bottom view of the device illustrated in FIG. 2*a*.

The structure of the actuating means A and B is determined by the constitution of the parts forming the corresponding horological functions. The driven pinion 2, respectively 3, on the one hand, carries teeth adapted to mesh with the teeth of the driving pinion 1, and on the other hand carries a coaxial mobile including teeth, or respectively a finger, adapted to cooperate with teeth, respectively the actuating means A, B, of the corresponding horological function. Purely by way of illustrative example, FIG. 2*b* shows a driven pinion 2 carrying a coaxial mobile constituted by four fingers 11 which can interact with internal teeth of a disk of the corresponding horological function, for example with the internal teeth of a date disk.

In summary, the mechanism described above comprises three pivoting sliding pinions, two of which preferably being housed in a corresponding oblong housing or formed by rings mounted about an eccentric axis, one of the three pinions, the central pinion 1, being housed in a manner such that it can selectively approach one of the two other lateral pinions 2, 3, by translation, using a control device as described below. A setting wheel 9 acts to drive the central pinion 1, this setting wheel itself being driven, for example with the aid of a winding and correction crown (not shown in the figures). The central pinion 1, which is therefore the driving pinion, can therefore transmit a rotational movement to the selected lateral pinion and, moreover, cause a translation of the selected lateral pinion towards one or the other of the ends of its oblong housing, or respectively, by generalizing, towards its first—or second driving position, this being a function of the direction of rotation of the central pinion, in a manner such that, depending on the direction of rotation, the selected lateral pinion selectively actuates one or the other of the horological functions that can be adjusted by the lateral pinion.

In accordance with the embodiment shown in FIGS. 1*a* to 3*b*, the control device is an assembly constituted by a yoke 4 controlled by a wig-wag 6 and a control lever 7, said assembly being mounted on the plate. The wig-wag 6 is prestressed by a wig-wag spring 8. The yoke 4 is locked with the aid of a yoke jumper 5 and a lug of the control lever 7. If the axis of the driving pinion 1 is produced in the form of a pin housed in an oblong slot in the plate, a U-shaped recess in the yoke accommodates one end of the axis of the driving pinion 1, in a manner such that swivelling of the yoke 4 following an actuation of the control lever 7 causes the axis of the pinion 1 to pass from one to the other of its two end positions in said oblong slot. If the axis of the driving pinion 1 is mounted on the yoke 4, the displacement thereof directly defines the end positions of the axis of the driving pinion 1. When the selection device in accordance with the invention is integrated into a timepiece, the user can control the position of the yoke 4 by means of a pusher symbolically indicated by an arrow in FIGS. 3*a* and 3*b* and enabling the control lever 7 to be actuated, and can modify the direction of rotation of the sliding pinion 1 by means of a crown actuating a stem, for example the winding stem, which can act on the setting wheel 9. Starting from the state of the adjusting device shown in FIG. 1*a*, for example, the user accesses the state of this device shown in FIG. 3*a* by acting on the control lever 7, i.e. by actuating said pusher, then changing the horological function actuated as shown in FIG. 3*b* by reversing the direction of rotation of the setting wheel 9, i.e. by turning the winding stem in the other direction.

FIGS. 5*a* to 7*b* illustrate a second adjusting device comprising a mechanism for selecting and actuating one function out of twelve available functions. This device is mounted on a plate 110 which may be, but does not necessarily have to be, in the form of a disk. Its mechanism comprises a drive setting wheel 109 which is capable of transmitting a movement of rotation to a driving pinion 101 in the clockwise direction and in the anti-clockwise direction at one's discretion. In the embodiment shown in the figures, the setting wheel 109 is mounted freely in rotation on one side of the plate 110, while the other parts, in particular an intermediate setting wheel 109*a* which is fixedly attached to the setting wheel 109 and coaxial therewith, are arranged on the other side of the plate 110. The axis of the driving pinion 101 (not visible in the figures) is housed in a rotary arm 112 the axis of articulation of which is preferably coaxial with the setting wheel 109*a*. Six angularly equidistant lateral pinions are arranged on the periphery of the plate 110. In the remainder of this description, only two of them, 102 and 103, will be described in detail, because this description applies mutatis mutandis to the four other pinions, the number of which may, furthermore, differ. The driving pinion 101 may be brought sufficiently closely to one or the other of the lateral pinions 102, 103 to form a kinematic connection between the central pinion 101 and either one or the other of the lateral pinions 102, 103, which each alternately become a driven pinion.

Figure 4A:
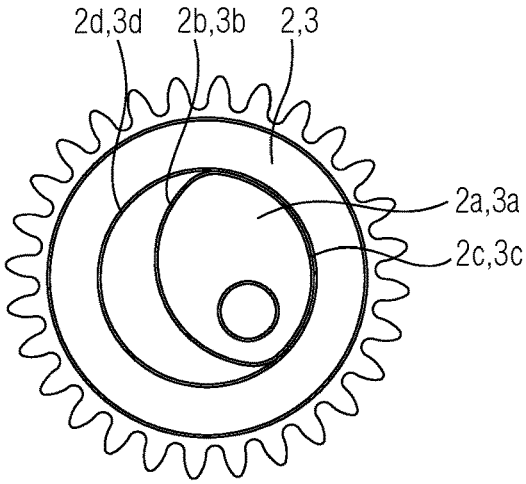
FIG. 4*a* shows a top plan view of an alternative arrangement of the driven pinions of an adjusting device in accordance with the present invention.
Figure 4B:
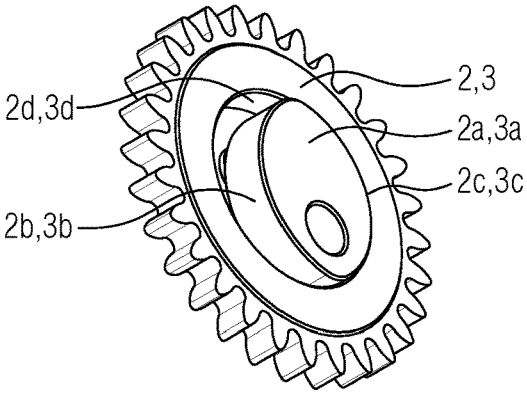
FIG. 4*b* shows a perspective top view of the driven pinion of FIG. 4*a*.
Figure 5A:
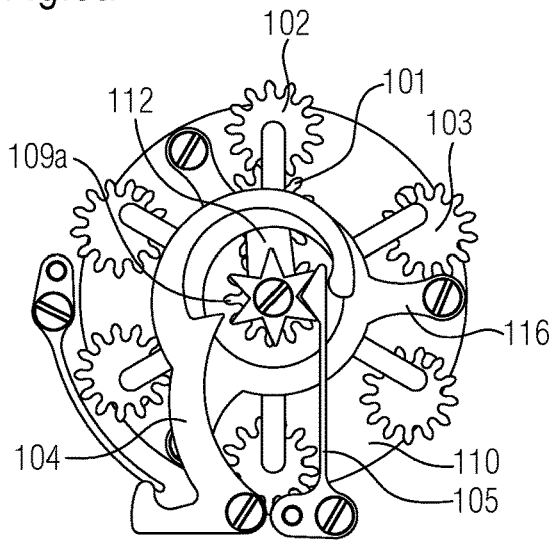
FIG. 5*a* shows a top plan view of a second embodiment of an adjusting device in accordance with the present invention allowing to adjust twelve horological functions.
Figure 5B:
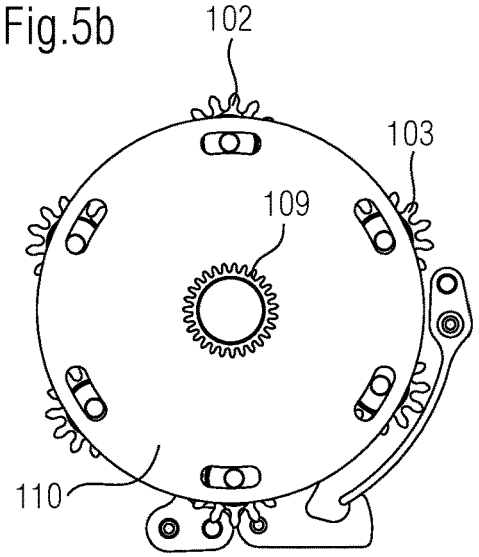
FIG. 5*b* shows a bottom plan view of the adjusting device of FIG. 5*a*.
Figure 6A:
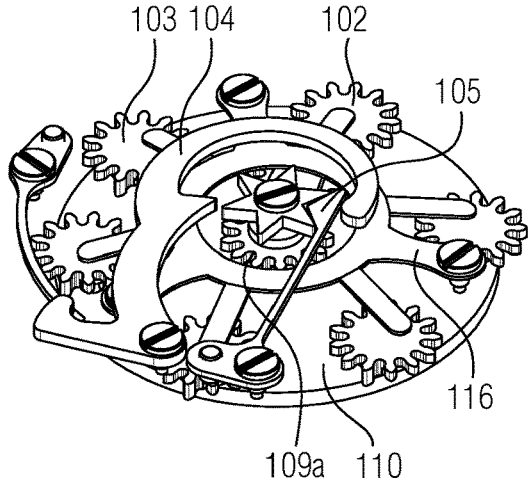
FIG. 6*a* represents a top perspective view of the device of FIG. 5*a*.
Figure 6B:
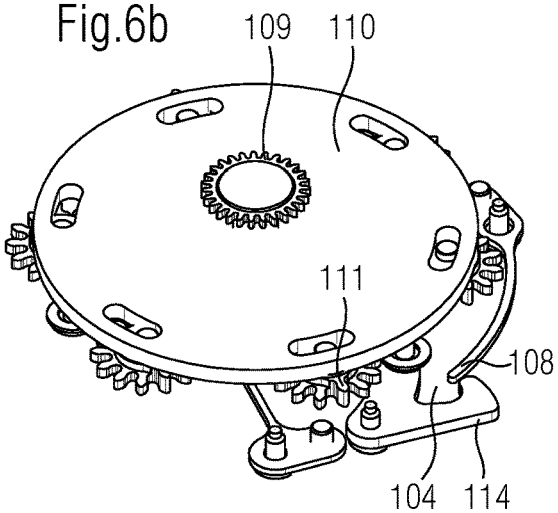
FIG. 6*b* is a bottom perspective view of the device illustrated in FIG. 5*b*.
Figure 7A:
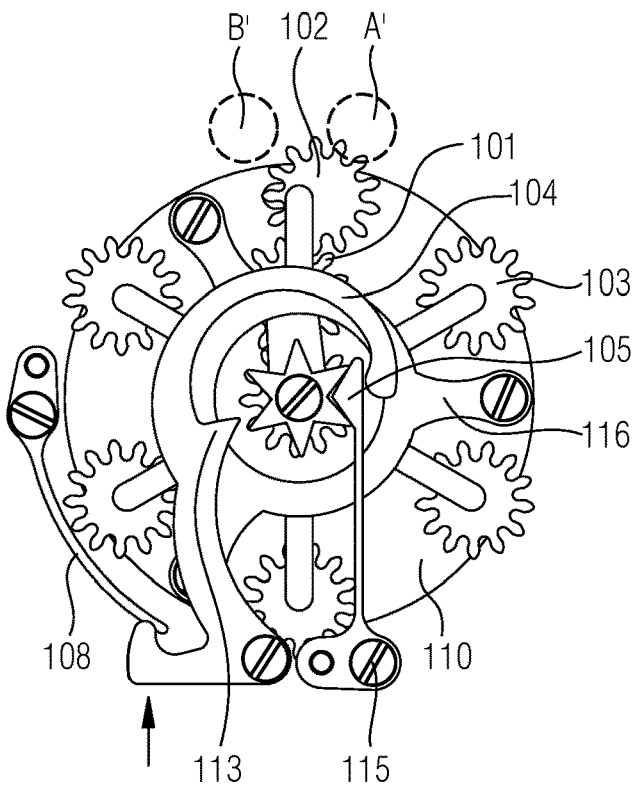
FIG. 7*a* is a top plan view of an adjusting device in accordance with FIG. 5*a* being driven.
Figure 7B:
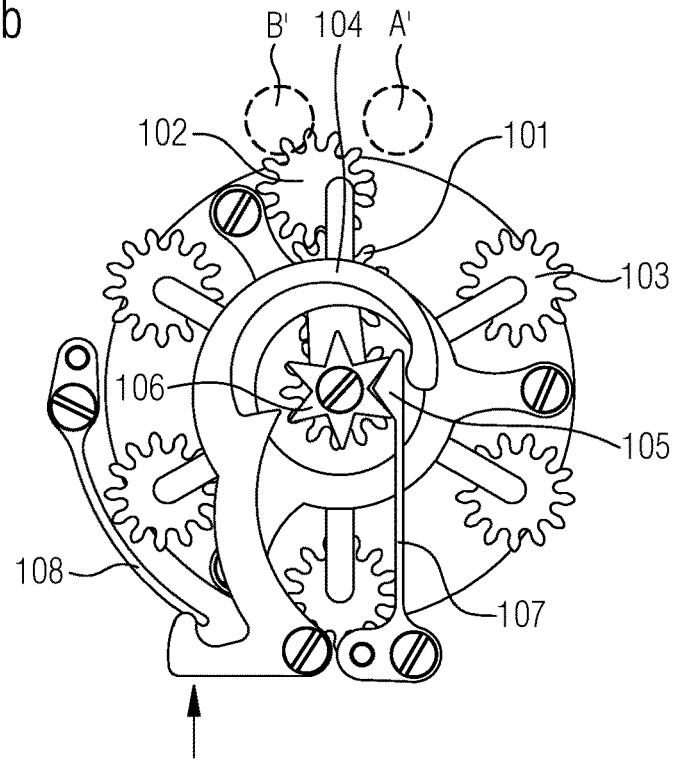
FIG. 7*b* is a top plan view of an adjusting device in accordance with FIG. 7*a* after reversing the direction of drive.

The axis of each of the lateral pinions 102, 103, which may be constituted by a pin, may be housed in an oblong housing constituted by a slot formed in the plate 110, the six oblong housings being disposed tangentially to a circle which is coaxial with the axis of articulation of said rotary arm 112 carrying the driving pinion 101 and, as can be seen in particular in FIGS. 7*a* and 7*b*, arranged in a manner such that the pin of the lateral pinion 102 kinematically connected to the driving pinion 101 moves to a first end of its oblong housing under the effect of rotation of the driving pinion 101 in the clockwise direction, the driven pinion 102 therefore being in a first position, and such that the pin of this lateral driven pinion 102 moves to the other end of its oblong housing under the effect of rotation of the driving pinion 101 in the anti-clockwise direction, the driven pinion 102 therefore being in said second position. FIGS. 7*a* and 7*b* illustrate this mechanism by showing the lateral pinion 102, driven by the central pinion 101, respectively in the first and in the second position of said lateral pinion 102, depending on whether the central pinion 101 brought into kinematic connection with the lateral pinion 102 by the control device described below, turns in the clockwise direction or in the anti-clockwise direction. Alternatively, and in a manner analogous to the corresponding discussions concerning the first adjusting device illustrated in FIGS. 1*a* to 3*b*, the driven pinions 102, 103 of the second adjusting device illustrated in FIGS. 5*a* to 7*b* could each be constituted by a ring having external teeth and a circular internal periphery, the axes of these driven pinions 102, 103 in this case possibly each being constituted by an eccentric fixed to said plate 110 and comprising two opposed circular arcs as illustrated in FIGS. 4*a* and 4*b*, in a manner such that each of these circular arcs can come into contact with said circular internal periphery of the corresponding driven ring 102, 103 depending on whether the central pinion 101 brought into kinematic connection with the ring 102, 103 turns in the clockwise direction or in the anti-clockwise direction. Similarly, a friction spring 116 comprising lateral arms bearing on the surface of the driven pinions 102, 103 is disposed on said plate 110 in order to secure the driven pinions 102, 103 in their respective axial positions, in a manner such that the operation of the adjusting device is ensured independently of the position in space of the corresponding timepiece.

An actuating means A' of a first horological function and an actuating means B' of a second horological function are indicated diagrammatically in FIGS. 7*a* and 7*b*, these means A', B' being disposed either side of the driven pinion 102 in a manner such that it can mesh alternately with the latter as a function of the position of this driven pinion 102. As can be seen in these two FIGS. 7*a* and 7*b*, the driven pinion 102 is configured to move into the first position under the effect of the driving pinion 101 when it turns in the clockwise direction, in which first position said driven pinion 102 actuates the actuating means A' of the first horological function, and to move into the second position under the effect of the driving pinion 101 when it turns in the anti-clockwise direction, in which second position said driven pinion 102 actuates the actuating means B' of the second horological function. Said driven pinion 102 does not actuate the actuating means A' of the first horological function when it is in its said second position and, vice versa, said driven pinion 102 does not actuate the actuating means B' of the second horological function when it is in its said first position. In analogous manner, the actuating means of two supplemental horological functions, not illustrated in FIGS. 7*a* and 7*b*, are disposed either side of the other driven pinions mounted around the driving pinion 101, these means being able to mesh alternately with these driven pinions as a function of their position, when the driving pinion 101 is in the meshed position with one of these driven pinions and as a function of the direction of rotation, clockwise or anti-clockwise, of the driving pinion 101. To generalize, by selecting the direction of rotation of the driving pinion 101 as well as its position, the device in accordance with the invention can therefore control a number of supplemental functions corresponding to double the number of driven pinions present in the device.

The structure of the actuating means A' and B' is determined by the constitution of the parts forming the corresponding horological functions. The driven pinions 102, 103 on the one hand carry teeth adapted to mesh with the teeth of the driving pinion 101, and on the other hand carry a coaxial mobile including teeth, or respectively a finger, which is adapted to cooperate with teeth, or respectively an actuating means A', B', of a horological function. Solely by way of illustrative example, FIG. 6*b* shows one of the driven pinions carrying a coaxial mobile having a finger 111 which can interact with teeth of a disk of the corresponding horological function.

In summary, the mechanism described above comprises six pivoting sliding pinions, each preferably housed in a corresponding oblong housing or formed by a ring mounted about an eccentric axis, enabling 2×6=12 functions to be selected and actuated. Another pinion, the central pinion 101, is housed on a rotary arm in a manner such that it can selectively approach one of the six lateral pinions by rotation of the arm, by means of a control device described below. A setting wheel 109 acts to drive the central pinion 101, this setting wheel itself being driven, for example, with the aid of a winding and correction crown (not shown in the figures). The central pinion 101, which is therefore the driving pinion, can thus transmit a rotational movement to the selected lateral pinion and, moreover, cause a translation of the selected lateral pinion towards one or the other of the ends of its oblong housing, respectively, by generalizing, towards its first—or second drive position, this being a function of the direction of rotation of the central pinion, in a manner such that, depending on the direction of rotation, the selected lateral pinion selectively actuates one or the other of the two horological functions which can be adjusted by the lateral pinion.

In the embodiment shown in FIGS. 5*a* to 7*b*, the control device for the rotary arm 112 is an assembly constituted by a star 106 which is fixed in rotation with respect to the rotary arm 112, a yoke 104, a jumper 105 which is capable of penetrating between the branches of the star 106 and which is prestressed towards the star 106 by a pre-tensioning spring 107 which itself is fixed via a screw 115 which can be used to adjust the pre-tensioning force of said pre-tensioning spring 107. Said assembly is mounted on the plate 110. The yoke 104 is provided with a yoke spring 108 bearing on a first free end of the yoke 104 and prestressing it in a manner such that a second free end of the yoke 104 bears on the jumper 105 and blocks it between the branches of the star 106. Thus, the star is locked by means of the jumper 105. The first free end of the yoke 104 carries an abutment 114 kinematically connected to an external impelling means such as a pusher, symbolically indicated by an arrow in FIGS. 7*a* and 7*b*. An impulse on the abutment 114 following an actuation of the external impelling means has the effect of pivoting the yoke 104, releasing the jumper 105 via the second free end of the yoke 104, and thus of releasing the star 106, as well as of impelling one of the branches of the star 106 via a lug 113 of the yoke 104, which causes a rotation of the star and thus of the rotary arm 112. The control device is calibrated in a manner such that this rotation corresponds to the angular interval between two lateral pinions 102, 103, the number of branches of the star being equal to the number of driven pinions. The driving pinion 101 thus passes from the driven pinion 102 to the driven pinion 103. Releasing of the external impelling means or respectively of the first free end of the yoke 104 causes the jumper 105 to return to between two branches of the star 106 and blocks the pinion 101 in its new position. When the selection device in accordance with the invention is integrated into a timepiece, the user can control the position of the yoke 104 by means of said pusher, meaning that said first free end of the yoke 104 can be actuated, and can modify the direction of rotation of the sliding pinion 101 by means of a crown actuating a stem, for example the winding stem, which can act on the setting wheel 109. By starting from the state of the adjusting device shown in FIG. 5*a*, for example, the user attains the state of this device shown in FIG. 7*a* by a rotation of the winding stem in one direction, then changing the actuated horological function as shown in FIG. 7*b* by reversing the direction of rotation of the stem, i.e. by turning the winding stem in the other direction.

The person skilled in the art will be able to vary the number of driven pinions as a function of the number of functions of the timepiece. In addition, without departing from the scope of the present invention, the yoke-type control devices described above may be replaced by other systems for displacing the driving pinion. Furthermore, the functions that can be adjusted in a given position of the yoke can be displayed on the dial of the timepiece using suitable measures which are familiar to the person skilled in the art, especially when a large number of horological functions have to be controlled by the adjusting device in accordance with the present invention.

In view of the aforementioned discussions pertaining to the structure and function of the device in accordance with the present invention, it is clear that such a device offers a number of advantages and can be used to accomplish the objectives defined in the introduction, especially the production of a device for unidirectional correction of a large number of horological functions via selection of the position as well as the direction of rotation of a driving pinion. Furthermore, these construction elements are robust as well as simple and reliable during use thereof. Because of the relatively simple structure of a device of this type, these advantages are obtained without in any way increasing production costs.

LIST OF REFERENCE NUMERALS

1 driving pinion
2 driven pinion
3 driven pinion
4 yoke
5 yoke jumper
6 wig-wag
7 control lever
8 wig-wag spring
9 drive setting wheel
10 friction spring
11 fingers of coaxial mobile
101 driving pinion
102 driven pinion
103 driven pinion
104 yoke
105 jumper
106 star
107 pre-tensioning spring
108 yoke spring
109 drive setting wheel
109*a* drive setting wheel
110 plate
111 finger
112 rotary arm
113 lug
114 abutment
115 screw
116 friction spring

The invention claimed is:

1. A device for adjusting horological functions of a timepiece, comprising:

a mechanism for selection and actuation that includes:

a drive mechanism, a driving pinion, said drive mechanism being configured to drive said driving pinion in a clockwise direction and in an anti-clockwise direction, at least two driven pinions adapted to be driven by said driving pinion when the driving pinion turns in a clockwise direction and when said driving pinion turns in an anti-clockwise direction, each of said driven pinions being configured to move into a first position when the driving pinion turns in the clockwise direction, in which first position each of said driven pinions actuates a first actuating mechanism of a first horological function, and to move into a second position when the driving pinion turns in the anti-clockwise direction, in which second position each of said driven pinions actuates a second actuating mechanism of a second horological function, each of said driven pinions not actuating the first actuating mechanism of the first horological function when in said second position and, vice versa, each of said driven pinions not actuating the second actuating mechanism of the second horological function when in said first position, wherein the adjusting device furthermore comprises a control mechanism adapted to selectively bring the driving pinion to mesh with each of said driven pinions.

2. The adjusting device according to claim 1, wherein said mechanism for selection and actuation comprises two driven pinions, and said control mechanism is configured to alternately bring the driving pinion, by translation, into contact with each of the two driven pinions.

3. The adjusting device according to claim 2, wherein the driving pinion is a sliding pinion, the axis of which comprises a pin housed in an oblong housing formed in a plate, in a manner such as to be able to slide perpendicularly to said axis, said control mechanism controlling sliding of the pin in said housing.

4. The adjusting device according to claim 3, wherein respective ends of the oblong housing of the axis of the driving pinion are arranged in a manner such as to allow effective engagement respectively with each of the driven pinions in each of said first and second positions of said driven pinions.

5. The adjusting device according to claim 3, wherein the control device comprises an assembly constituted by a yoke controlled by a wig-wag and a control lever, said assembly being mounted on said plate.

6. The adjusting device according to claim 1, wherein the control mechanism comprises a rotary arm on which the driving pinion is arranged, and said control mechanism is configured to bring said driving pinion into the meshing position with each of the driven pinions by successive rotation.

7. The adjusting device according to claim 6, wherein the control mechanism comprises an assembly formed by a star which is coaxial with the axis of articulation of said rotary arm, by a jumper, and by a spring yoke cooperating with said star, a rotation of the star through an angular value corresponding to one branch of the star bringing the driving pinion from a meshing position with a driven pinion into a meshing position with the adjacent driven pinion.

8. The adjusting device according to claim 6, wherein the driving pinion is kinematically connected to its drive means via a setting wheel which is coaxial with the axis of articulation of said rotary arm.

9. The adjusting device according to claim 1, wherein said driven pinion is constituted by a sliding pinion which is capable of sliding perpendicularly to its axis of rotation, in a manner such that the driven pinion moves into said first position under an effect of rotation of the driving pinion in the clockwise direction and that the driven pinion moves into said second position under an effect of rotation of the driving pinion in the anti-clockwise direction.

10. The adjusting device according to claim 9, wherein the axis of said driven pinion comprises a pin fixed to the driven pinion and housed in an oblong housing formed in a plate, in a manner such that said pin is capable of sliding perpendicularly to said axis, said housing being disposed in a manner such that the pin of the driven pinion moves to a first end of the oblong housing under the effect of rotation of the driving pinion in the clockwise direction, the driven pinion therefore being located in said first position, and that the pin moves to the other end of the oblong housing under the effect of rotation of the driving pinion in the anti-clockwise direction, the driven pinion therefore being located in said second position.

11. The adjusting device according to claim 9, wherein the axis of said driven pinion comprises an eccentric fixed to a plate and comprising two opposed circular arcs, the pinion comprising a ring having external teeth and a circular internal periphery which is capable of alternately coming into contact with one of the two opposed circular arcs of said eccentric, in a manner such that said ring can slide perpendicularly to said axis, such that the circular internal periphery of the ring comprising the driven pinion comes into contact with the first circular arc of the eccentric under the effect of rotation of the driving pinion in the clockwise direction, the driven pinion therefore being in said first position; and that the circular internal periphery of the ring comprising the driven pinion comes into contact with the second circular arc of the eccentric under the effect of rotation of the driving pinion in the anti-clockwise direction, the driven pinion therefore being located in said second position.

12. The adjusting device according to claim 9, wherein the driven pinion carries teeth adapted to mesh with the teeth of the driving pinion, and carries a coaxial mobile the teeth or respectively a finger of which is/are adapted to cooperate with teeth, or respectively an actuating mechanism, of a horological function.

13. The adjusting device according to claim 1, wherein the driving pinion is kinematically connected via setting wheels, with a winding and/or adjusting crown of the timepiece.

14. A timepiece, comprising the device for adjusting horological functions according to claim 1.

* * * * *